US008795446B2

(12) United States Patent
Kaneko et al.

(10) Patent No.: US 8,795,446 B2
(45) Date of Patent: Aug. 5, 2014

(54) COPPER ALLOY MATERIAL, ELECTRICAL OR ELECTRONIC PARTS, AND METHOD OF PRODUCING A COPPER ALLOY MATERIAL

(75) Inventors: Hiroshi Kaneko, Tokyo (JP); Kiyoshige Hirose, Tokyo (JP); Tatsuhiko Eguchi, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 301 days.

(21) Appl. No.: 13/091,688

(22) Filed: Apr. 21, 2011

(65) Prior Publication Data

US 2011/0192505 A1 Aug. 11, 2011

Related U.S. Application Data

(63) Continuation of application No. PCT/JP2009/068203, filed on Oct. 22, 2009.

(30) Foreign Application Priority Data

Oct. 22, 2008 (JP) ..... 2008-271967

(51) Int. Cl.
*C22C 9/02* (2006.01)
*C22F 1/08* (2006.01)

(52) U.S. Cl.
USPC ..... 148/433; 148/434; 148/435; 148/682; 420/470; 420/471; 420/472; 420/473; 420/485; 420/486; 420/487; 420/488

(58) Field of Classification Search
USPC ..... 148/433–435, 682; 420/470–473, 420/485–488
See application file for complete search history.

(56) References Cited

U.S. PATENT DOCUMENTS

2008/0190523 A1 8/2008 Gao et al.
2009/0257909 A1 10/2009 Mihara et al.
2011/0223056 A1* 9/2011 Aruga et al. ..... 420/471

FOREIGN PATENT DOCUMENTS

JP 2006-9137 A 1/2006
JP 2006-152392 A 6/2006
JP 2006-283059 A 10/2006
JP 2007-100145 A 4/2007

(Continued)

OTHER PUBLICATIONS

Extended European Search Report dated Jun. 4, 2012, for European Application No. 09822070.0, PCT/JP2009/068203.

(Continued)

*Primary Examiner* — Sikyin Ip
(74) *Attorney, Agent, or Firm* — Birch, Stewart, Kolasch & Birch, LLP

(57) ABSTRACT

A copper alloy material, having an alloy composition containing any one or both of Ni and Co in an amount of 0.4 to 5.0 mass % in total, and Si in an amount of 0.1 to 1.5 mass %, with the balance being copper and unavoidable impurities, wherein a ratio of an area of grains in which an angle of orientation deviated from S-orientation {2 3 1}<3 4 6> is within 30° is 60 % or more, according to a crystal orientation analysis in EBSD measurement; an electrical or electronic part formed by working the copper alloy material; and a method of producing the copper alloy material.

4 Claims, 1 Drawing Sheet

(56) References Cited

FOREIGN PATENT DOCUMENTS

| | | | |
|---|---|---|---|
| JP | 2007-169765 | * | 7/2007 |
| JP | 2007-169765 A | | 7/2007 |
| JP | 2008-13836 A | | 1/2008 |
| JP | 2008-38231 A | | 2/2008 |
| JP | 2008-95185 A | | 4/2008 |
| JP | 2008-223136 A | | 9/2008 |

OTHER PUBLICATIONS

Humphreys, "Recrystallization and Related Annealing Phenomena", XP002675903, Elsevier, Dec. 31, 2004, pp. V and 70.

International Search Report for PCT/JP2009/068203, mailed on Jan. 19, 2010.

* cited by examiner

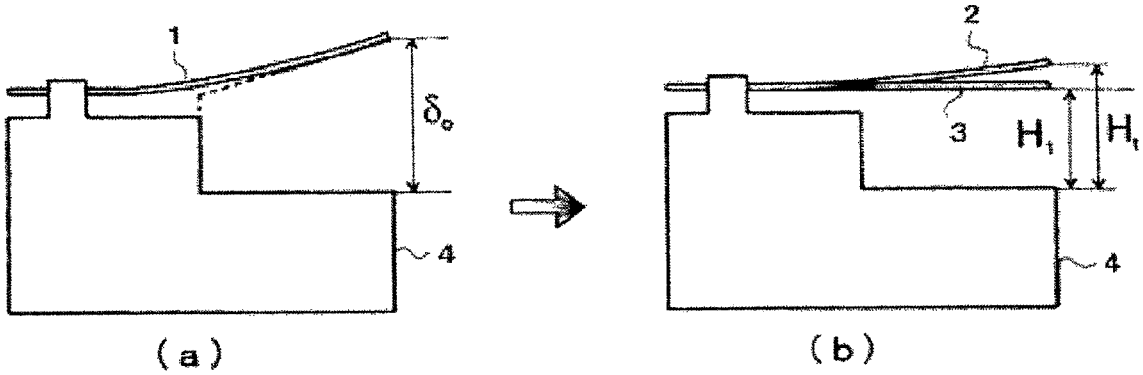
1
$\delta_0$
4
(a)
2
3
$H_1$
$H_1$
4
(b)

COPPER ALLOY MATERIAL, ELECTRICAL OR ELECTRONIC PARTS, AND METHOD OF PRODUCING A COPPER ALLOY MATERIAL

CROSS REFERENCE TO RELATED APPLICATION

This application is a Continuation of PCT International Application No. PCT/JP2009/068203 filed on Oct. 22, 2009, which claims priority under 35 U.S.C. 119(a) to Patent Application No. 2008-271967 filed in Japan, on Oct. 22, 2008. The entire contents of all of the above applications is hereby incorporated by reference into the present application.

TECHNICAL FIELD

The present invention relates to a copper alloy material that is applicable to lead frames, connectors, terminal materials, relays, switches, sockets, and the like for electrical or electronic equipments, to electrical or electronic parts utilizing the same, and to a method of producing the copper alloy material.

BACKGROUND ART

The properties required for a copper alloy material to be used for the uses in electrical or electronic equipments include, for example, electrical conductivity, proof stress (yield stress), tensile strength, bending property, and stress relaxation resistance. In recent years, the demanded level for those properties becomes higher, concomitantly with the size reduction, weight reduction, enhancement of the performance, high density packaging, or the temperature rise in the use environment, of electrical or electronic equipments.

Conventionally, in addition to iron-based materials, copper-based materials, such as phosphor bronze, red brass, and brass, have also been widely used in general as the materials for electrical or electronic equipments. These copper alloys acquire enhanced strength through a combination of solid solution strengthening of tin (Sn) or zinc (Zn) and work hardening based on cold working such as rolling or drawing. In this method, since the electrical conductivity is insufficient, and high mechanical strength is obtained by making a cold working ratio high, the bending property or stress relaxation resistance is lowered.

As a strength-enhancing method for replacing this, in addition to the combination of solid solution strengthening and work hardening, precipitation strengthening is available by which a fine second phase is precipitated in the material. This strengthening method has advantages of enhancing the strength as well as simultaneously enhancing the electrical conductivity, and accordingly, this strengthening method has been implemented with many alloy systems.

Among them, a Cu—Ni—Si-based alloy which is strengthened by finely precipitating compounds of nickel (Ni) and silicon (Si) in copper (Cu) (for example, C70250 as a CDA [Copper Development Association]-registered alloy) is high in strength, and is widely used. Furthermore, a Cu—Ni—Co—Si-based alloy or a Cu—Co—Si-based alloy, in which a part or the entirety of Ni is substituted with cobalt (Co), has an advantage of having higher electrical conductivity than the Cu—Ni—Si system, and these alloys are being used in some applications.

However, along with the recent downsizing of the parts to be used in electronic equipments or automobiles, the electric/electronic parts to be used are subjected to bending at a smaller radius, and thus there is a strong demand for a copper alloy material high in mechanical strength and excellent in bending property. In order to obtain high strength in the conventional Cu—Ni—Co—Si system or Cu—Ni—Si system, potent work hardening may be utilized to enhance the strength by increasing the working ratio in rolling, but this method deteriorates bending property as described above, and thus a good balance between high strength and satisfactory bending property cannot be achieved.

In regard to this demand for enhancement of bending property, some proposals are already made to solve the problem by controlling crystal orientation. It has been found in Patent Literature 1 that in regard to a Cu—Ni—Si-based copper alloy, bending property is excellent when the copper alloy has a crystal orientation such as that the grain size and the X-ray diffraction intensities obtained from {3 1 1}, {2 2 0} and {2 0 0} planes satisfy certain conditions. Further, it has been found in Patent Literature 2 that in regard to a Cu—Ni—Si-based copper alloy, bending property is excellent when the copper alloy has a crystal orientation in which the X-ray diffraction intensities obtained from {2 0 0} plane and {2 2 0} plane satisfy certain conditions. It has also been found in Patent Literature 3 that in regard to a Cu—Ni—Si-based copper alloy, excellent bending property is obtained by controlling the ratio of the cube orientation {1 0 0} <0 0 1>.

CITATION LIST

Patent Literatures

Patent Literature 1: JP-A-2006-009137 ("JP-A" means unexamined published Japanese patent application)
Patent Literature 2: JP-A-2008-013836
Patent Literature 3: JP-A-2006-283059

SUMMARY OF INVENTION

Technical Problem

However, in the inventions described in Patent Literature 1 and Patent Literature 2, the analysis of crystal orientation by X-ray diffraction from particular planes is related only to quite limited particular planes in the distribution of crystal orientations of a certain extent. Thus, those techniques are often unsatisfactory for controlling the crystal orientations, with their effects of improving bending property being insufficient. Further, in the invention described in Patent Literature 3, the control of the crystal orientation is realized by a reduction of a working ratio in rolling after solution heat treatment, thus the resultant alloy may be insufficient in mechanical strength in some cases. On the other hand, along with the recent further downsizing, enhancement of the performance, high-density packaging, and the like of electrical or electronic equipments, the copper alloy materials for the electrical or electronic equipments have been required to have a bending property higher than the bending property assumed in the inventions described in the patent literatures mentioned above. However, it is very difficult to satisfy this demand within the scope of techniques described in the patent literatures.

Under such problems, the present invention is contemplated for providing a copper alloy material which is excellent in bending property and mechanical strength, and which is favorable for lead frames, connectors, terminal materials, and the like for electrical or electronic equipments, and connectors, terminal materials, relays, switches, and the like to be mounted on automobile vehicles, or other uses, for providing an electrical or electronic part utilizing the same, and for providing a method of producing the copper alloy material.

Solution to Problem

The inventors of the present invention have conducted studies on copper alloys favorable for the applications in electrical or electronic parts, and paid attention to the mono-orientation or degree of integration of the crystal orientation, in order to improve or enhance the bending property, mechanical strength, electrical conductivity, and stress relaxation resistance remarkably in Cu—Ni—Si-based, Cu—Ni—Co—Si-based, or Cu—Co—Si-based copper alloys, and have found that there are correlations particularly between the bending property and the degree of integration at an orientation within 30° around the S-orientation {2 3 1} <3 4 6>. Then, after having keenly studied, the inventors have attained the present invention.

According to the present invention, there is provided the following means:

(1) A copper alloy material, having an alloy composition comprising any one or both of Ni and Co in an amount of 0.4 to 5.0 mass % in total, and Si in an amount of 0.1 to 1.5 mass %, with the balance being copper and unavoidable impurities, wherein a ratio of an area of grains in which an angle of orientation deviated from S-orientation {2 3 1} <3 4 6> is within 30° is 60% or more, according to a crystal orientation analysis in EBSD measurement.

(2) The copper alloy material according to the above item (1), wherein particles, which are composed of at least two elements among a first group of elements to be added consisting of Ni, Co, and Si, and which have a diameter from 50 to 1,000 nm, exist in a density from $10^4$/mm$^2$ to $10^8$/mm$^2$.

(3) A copper alloy material, having an alloy composition comprising any one or both of Ni and Co in an amount of 0.4 to 5.0 mass % in total, Si in an amount of 0.1 to 1.5 mass %, and at least one element selected from a second group of elements to be added consisting of B, P, Cr, Fe, Ti, Zr, Mn, Al, and Hf in an amount of 0.005 to 1.0 mass % in total, with the balance being copper and unavoidable impurities, wherein a ratio of an area of grains in which an angle of orientation deviated from S-orientation {2 3 1} <3 4 6> is within 30° is 60% or more, according to a crystal orientation analysis in EBSD measurement.

(4) The copper alloy material according to the above item (3), wherein at least one kind of particles selected from the group consisting of: particles which are composed of at least two elements among a first group of elements to be added consisting of Ni, Co, and Si and have a diameter of 50 to 1,000 nm; particles which contain at least one element selected from the first group of elements to be added and at least one element selected from the second group of elements to be added as constituent elements and have a diameter of 50 to 1,000 nm; and particles which contain at least two elements selected from the second group of elements to be added as constituent elements and have a diameter of 50 to 1,000 nm, exist in a density from $10^4$/mm$^2$ to $10^8$/mm$^2$ in total.

(5) A copper alloy material, having an alloy composition comprising any one or both of Ni and Co in an amount of 0.4 to 5.0 mass % in total, Si in an amount of 0.1 to 1.5 mass %, and at least one element selected from a third group of elements to be added consisting of Sn, Zn, Ag, and Mg in an amount of 0.005 to 2.0 mass % in total, with the balance being copper and unavoidable impurities, wherein a ratio of an area of grains in which an angle of orientation deviated from S-orientation {2 3 1} <3 4 6> is within 30° is 60% or more, according to a crystal orientation analysis in EBSD measurement.

(6) The copper alloy material according to the above item (5), wherein particles, which are composed of at least two elements among a first group of elements to be added consisting of Ni, Co, and Si, and which have a diameter from 50 to 1,000 nm, exist in a density from $10^4$/mm$^2$ to $10^8$/mm$^2$.

(7) A copper alloy material, having an alloy composition comprising any one or both of Ni and Co in an amount of 0.4 to 5.0 mass % in total, Si in an amount of 0.1 to 1.5 mass %, at least one element selected from a second group of elements to be added consisting of B, P, Cr, Fe, Ti, Zr, Mn, Al, and Hf in an amount of 0.005 to 1.0 mass % in total, and at least one element selected from a third group of elements to be added consisting of Sn, Zn, Ag, and Mg in an amount of 0.005 to 2.0 mass % in total, with the balance being copper and unavoidable impurities, wherein a ratio of an area of grains in which an angle of orientation deviated from S-orientation {2 3 1} <3 4 6> is within 30° is 60% or more, according to a crystal orientation analysis in EBSD measurement.

(8) The copper alloy material according to the above item (7), wherein at least one kind of particles selected from the group consisting of: particles which are composed of at least two elements among a first group of elements to be added consisting of Ni, Co, and Si and have a diameter of 50 to 1,000 nm; particles which contain at least one element selected from the first group of elements to be added and at least one element selected from the second group of elements to be added as constituent elements and have a diameter of 50 to 1,000 nm; and particles which contain at least two elements selected from the second group of elements to be added as constituent elements and have a diameter of 50 to 1,000 nm, exist in a density from $10^4$/mm$^2$ to $10^8$/mm$^2$ in total.

(9) An electrical or electronic part formed by working the copper alloy material according to any one of the above items (1) to (8).

(10) A method of producing the copper alloy material according to any one of the above items (1) to (8), comprising the steps of:

casting a copper alloy to give the alloy composition, to obtain an ingot [step 1]; subjecting the ingot to a homogenization heat treatment [step 2]; hot rolling the homogenization heat treated ingot [step 3]; cold rolling [step 6]; subjecting to a heat treatment [step 7]; subjecting to an intermediate solution heat treatment [step 8]; cold rolling [step 9]; subjecting to an aging precipitation heat treatment [step 10]; finish cold rolling [step 11]; and temper annealing [step 12], in this order as mentioned, wherein the step of hot rolling [step 3] is carried out at a working ratio of 50% or more at 500° C. or above; the step of heat treatment [step 7] is carried out at 400° C. to 800° C. for a time period within the range of 5 seconds to 20 hours; and when the working ratio in the step of cold rolling [step 9] is designated as R1 (%) and the working ratio in the step of finish cold rolling [step 11] is designated as R2(%), the value of R1+R2 is set to the range of 5 to 65%.

Herein, the term "particles" simply referred to means particles of a precipitate (an intermetallic compound) precipitated in a matrix, which particles are distinguished from the grains in the matrix.

Advantageous Effects of Invention

The copper alloy material of the present invention, preferably a copper alloy sheet material, is excellent in properties of mechanical strength, bending property, electrical conductivity, and stress relaxation resistance, and is preferably favorable for the use in parts of electrical or electronic equipments.

Since the electrical or electronic equipment parts of the present invention are comprised of the copper alloy material described above, the electrical or electronic equipment parts exhibit excellent effects in which they can cope with bending at a smaller radius.

Furthermore, the method of producing a copper alloy material of the present invention is preferably favorable as a method of producing the copper alloy material described above.

Other and further features and advantages of the invention will appear more fully from the following description, appropriately referring to the accompanying drawings.

BRIEF DESCRIPTION OF DRAWINGS

FIGS. 1(*a*) and 1(*b*) are explanatory diagrams for the method of testing the stress relaxation resistance, in which FIG. 1(*a*) shows the state before heat treatment, and FIG. 1(*b*) shows the state after the heat treatment.

DESCRIPTION OF EMBODIMENTS

Preferable embodiments of the copper alloy material of the present invention will be described in detail. Herein, the term "copper alloy material" means a product obtained after a copper alloy base material (herein, the "copper alloy base material" has a given alloy composition but before being worked) is worked into a predetermined shape (for example, sheet, strip, foil, rod, or wire). Herein, explanation will be given on a sheet material and a strip material.

In the present invention, when the respective amounts of addition of nickel (Ni), cobalt (Co), and silicon (Si), which form the first group of elements to be added to copper (Cu), are brought under control, Ni—Si, Co—Si, and/or Ni—Co—Si compounds can be precipitated, to thereby enhance the mechanical strength of the resultant copper alloy. The contents of any one of or two of Ni and Co are, in total, from 0.4 to 5.0 mass %, preferably 0.6 to 4.5 mass %, and more preferably 0.8 to 4.0 mass %. The content of Ni is preferably 0.5 to 3.0 mass %, more preferably 0.5 to 2.8 mass %; and the content of Co is preferably 0.2 to 1.5 mass %, more preferably 0.3 to 1.2 mass %. If the amounts of addition of Ni and Co in total are larger than 5.0 mass %, the electrical conductivity is lowered; and, if the amounts of addition in total are smaller than 0.4 mass %, the strength is insufficient. Further, the content of Si is 0.1 to 1.5 mass %, preferably 0.2 to 1.2 mass %.

In order to improve the bending property of copper alloy materials, the inventors of the present invention have conducted investigation on the cause of cracks occurring at the bent portion. As a result, we found that as a feature of a material poor in bending property, dislocation or work hardening locally accumulates in the periphery of a grain boundary having a large tilt angle, and stress is concentrated there, so that cracks finally occur. As a countermeasure, we found that aligning the crystal orientation is effective, in reducing the proportion of the grain boundary having a large tilt angle. That is, we found that when the ratio of the area of grains in which the angle of orientation deviated from the S-orientation {2 3 1} <3 4 6> is within 30°, is 60% or more, the resultant copper alloy material exhibits satisfactory bending property. As this mono-orientation property is enhanced, the bending property becomes better and better, and this ratio of the area is preferably 70% or more, more preferably 80% or more. The definition of the ratio of the area as used herein will be described later.

Herein, the method of indicating the crystal orientation in the present specification is such that a Cartesian coordinate system is employed, representing the rolling direction (RD) of the material in the X-axis, the transverse direction (TD) in the Y-axis, and the direction normal to the rolling direction (ND) in the Z-axis, various regions in the material are indicated in the form of (h k l) [u v w], using the index (h k l) of the crystal plane that is perpendicular to the Z-axis (parallel to the rolled plane) and the index [u v w] in the crystal direction parallel to the X-axis. Further, the orientation that is equivalent based on the symmetry of the cubic crystal of a copper alloy is indicated as {h k l} <u v w>, using parenthesis symbols representing families, such as in (1 3 2) [6 −4 3], and (2 3 1) [3 −4 6].

The analysis of the crystal orientation in the present invention is conducted using the EBSD method. The EBSD method, which stands for Electron Back Scatter Diffraction, is a technique of crystal orientation analysis using reflected electron Kikuchi-line diffraction (Kikuchi pattern) that occurs when a sample is irradiated with an electron beam under a scanning electron microscope (SEM). A sample area measured 500 μm on each of the four sides and containing 200 or more grains, was subjected to an analysis of the orientation, by scanning in a stepwise manner at an interval of 0.5 μm.

In the present invention, the grains having orientation components of the texture of the S-orientation and the area of the planes of atoms thereof are defined in connection with whether the grains and the area are within the range of the predetermined deviation angle that will be described below.

In regard to the deviation angle from the ideal orientation represented by the above-mentioned index, for (i) the crystal orientation at each measurement point and (ii) the S-orientation as an ideal orientation as an object measurement, an angle of rotation around the axis of rotation that is common to (i) and (ii) is calculated, and the angle of rotation is designated as the deviation angle. For example, with regard to the S-orientation (2 3 1) [6 −4 3], the orientation (1 2 1) [1 −1 1] is in a relationship of being rotated by 19.4° around the (20 10 17) direction as the axis of rotation, and this angle is designated as the deviation angle. The common axis of rotation consists of three integers of 40 or less, but the integer that can be expressed with the smallest deviation angle among the integers of 40 or less is employed. This deviation angle is calculated for all measurement points, and the number including up to the first decimal place is designated as the effective number. The area of grains having an orientation within 30° from the S-orientation is divided by the total measured area, and the resultant value is designated as the ratio of the area of atomic planes having the S-orientation.

The data obtained from the orientation analysis based on EBSD includes the orientation data to a depth of several tens nanometers, through which the electron beam penetrates into the sample. However, since the depth is sufficiently small as compared with the width to be measured, the data is described in terms of ratio of an area in the present specification. Furthermore, since the orientation distribution varies along the sheet thickness direction, it is preferable to carry out the orientation analysis by EBSD at several arbitrary points along the sheet thickness direction, and calculating the average.

Next, the method of integrating the crystal orientation of a copper alloy on an orientation centered in the S-orientation will be described. Herein, the explanation will be given by taking a sheet material (bar material) of a precipitate-type copper alloy as an example.

In general, a precipitation-type copper alloy is produced by the steps of: subjecting an ingot which has been subjected to a homogenization heat treatment, to steps of hot working and cold working, to give a thin sheet, and then to subject the thin sheet to an intermediate solution heat treatment at a temperature in the rang of 700° C. to 1,020° C., to thereby form a solid solution of solute atoms again, followed by an aging precipitation heat treatment and a finish cold-rolling, to satisfy the required strength. In these series of steps, the texture of the copper alloy is approximately determined by the recrystallization that occurs upon the intermediate solution heat treatment, and is finally determined by the rotation of orientation that occurs upon the finish rolling.

Here, the inventors of the present invention obtained the following findings, in connection with the crystal orientation in the texture of a copper alloy. This findings include, for example, in regard to a rolled material of a copper alloy, that (1) it is important, for enhancement of the bending property, to have a high proportion of crystal orientations having a deviation angle within the range of 30° centered around the S-orientation in the rolled material of a finished state; and that (2) on the premise of the above item (1), the S-orientation and the crystal orientations having a deviation angle within the range of 30° around the S-orientation are included at a high proportion in the rolled material before being subjected to an intermediate solution heat treatment, and preserving the crystal orientation of the rolled material upon recrystallization in the intermediate solution heat treatment, is important to increase the proportion of the S-orientation and the crystal orientations having a deviation angle within the range of 30° around the S-orientation in the finished state.

Furthermore, we found that, in order to preserve the crystal orientation of the rolled material upon the intermediate solution heat treatment, it is effective to disperse particles having a diameter of 50 to 100 nm in a solution heat treated material in a density of $10^4/mm^2$ to $10^8/mm^2$. This is because, we think, when the rolled material is recrystallized by the intermediate solution heat treatment, these particles suppress migration of the recrystallization interface, and the growth of grains suppresses development of crystal orientations having a large deviation angle with the S-orientation, such as the cube orientation.

When the particle size is less than 50 nm, or when the density of particles is lower than $10^4/mm^2$, the effect of suppressing the migration of grain boundaries is not sufficiently obtained, which is not preferable. Furthermore, when the particle size is more than 1,000 nm, or when the density of particles is more than $10^8/mm^2$, the particles serve as stress concentration points in bending deformation, and cause the occurrence of cracks, which is not preferable. The particle size is more preferably 75 to 800 nm, and the density of particles is more preferably $5\times10^4/mm^2$ to $5\times10^7/mm^2$.

Examples of the method of dispersing particles having a diameter of 50 to 1,000 nm in an intermediate solution heat treated material in a density of $10^4/mm^2$ to $10^8/mm^2$, include two methods, that is, a method of adding an additive element, and a method based on a production process of introducing an annealing step before the intermediate solution heat treatment. Any of these two methods is capable of dispersing particles in an intermediate solution heat treated material. Furthermore, even when those two methods are used in combination, particles can also be dispersed in an intermediate solution heat treated material.

In the case of using elements of the first group of elements to be added, particles can be dispersed in the texture only by the production process without using other additive elements. Examples of the constituent elements of the particles include Ni—Si, Co—Si, Ni—Co—Si, Ni—Cu—Si, Co—Cu—Si, and Ni—Co—Cu—Si.

Furthermore, when elements of the second group of elements to be added which are different from the elements of the first group of elements to be added are used, particles can be dispersed in the texture. In this case, effective examples of the elements of the second group of elements to be added include B, P, Cr, Fe, Ti, Zr, Mn, Al, and Hf. Examples of the methods of dispersing particles in the texture using the elements of the second group of elements to be added, include (a) a case where the particles are composed of an elementary substance of the elements of the second group of elements to be added, (b) a case where the particles are composed of compounds formed from the elements of the second group of elements to be added and other additive elements, and (c) a case where the particles are composed of compounds formed from the elements of the second group of elements to be added and copper, such as Cu—Zr and Cu—Hf. Furthermore, examples of the method of (b) include (b1) a case where the elements of the first group of elements to be added and the elements of the second group of elements to be added form compounds, and (b2) the elements of the second group of elements to be added form compounds by themselves. The case of (b1) as described above involves the formation of compounds, such as Cr—Ni—Si, Co—Cr—Si, Ni—Zr, Ni—Mn—Zr, Ni—Ti, Co—Ti, Ni—Co—Ti, Fe—Ni—Si, Fe—Si, Mn—Si, Ni—Mn—P, Ni—P, Fe—Ni—P, Ni—B, Ni—Cr—B, Ni—Co—B, Ni—Co—Hf—Si, Ni—Co—Al, and Co—Ni—P. Similarly, the case of (b2) as described above involves the formation of compounds, such as Fe—P, Fe—Zr, Mn—B, Fe—B, Cr—B, Mn—Fe—B, Mn—Zr, Fe—Mn—Zr, Mn—Zr, Al—Hf, Al—Zr, and Al—Cr.

Furthermore, in the case of using the elements of the second group of elements to be added, when the method based on the production process of subjecting to an annealing heat treatment before the intermediate solution heat treatment, is carried out, in addition to the method of adding the additive elements that form the above-mentioned compounds of (b1), (b2) and the like, the particles can be more readily dispersed in the intermediate solution heat treated material.

If the total amount of the elements of the second group of elements to be added exceeds 1.0 mass %, it results in harmful lowering of the electrical conductivity, which is not preferable. When any of the second group of elements to be added is added, in order to sufficiently utilize the effects of adding the same and to prevent a lowering in the electrical conductivity, the element needs to be added in a total amount of 0.005 to 1.0 mass %, preferably 0.01 to 0.9 mass %, and more preferably 0.03 to 0.8 mass %.

Next, the method of the present invention of producing the copper alloy material will be described. The state according to the present invention in which the ratio of the area of grains having a deviation angle of within 30° from the S-orientation is 60% or more, can be obtained, for example, according to the production method of the present invention.

Generally, the method of producing a precipitation-type copper alloy is to conduct: a casting [step 1] of a copper alloy material to obtain an ingot, subjecting this ingot to a homogenization heat treatment [step 2], a hot working [step 3], such as hot rolling, a water cooling [step 4], a face milling [step 5], and a cold rolling [step 6], in this sequence, to give a thin sheet, and then to subject the thin sheet to an intermediate solution heat treatment [step 8] at a temperature in the rang of 700° C. to 1,020° C., to thereby form a solid solution of solute atoms again, followed by an aging precipitation heat treatment [step 10], and a finish cold rolling [step 11], to satisfy the required strength. In these series of steps, the texture of the material is approximately determined by the recrystallization that occurs upon the intermediate solution heat treatment, and is finally determined, by the rotation of orientation that occurs upon the finish rolling.

As an example of the method of producing a copper alloy material of the present invention, mention can be made of a method of obtaining the copper alloy material of the present invention by carrying out [step 1] to [step 12] in the following order: melting a copper alloy material formed from a predetermined alloy component composition by a high frequency melting furnace, followed by casting, to obtain an ingot [step 1]; subjecting the ingot to a homogenization heat treatment at 900° C. to 1,020° C. for 3 minutes to 10 hours [step 2]; hot rolling at a working ratio of 50% to 99% at a temperature in the range of 500° C. to 1,020° C. [step 3]; water cooling [step 4]; face milling [step 5]; cold rolling at a working ratio of 50% to 99.8% [step 6]; (annealing) heat treatment by maintaining at 400° C. to 800° C. for 5 seconds to 20 hours [step 7]; intermediate solution heat treatment by maintaining at 750° C. to 1,020° C. for 5 seconds to 1 hour [step 8]; cold working at a working ratio R1 of 2.5% to 50% [step 9]; aging precipitation heat treatment at 400° C. to 700° C. for 5 minutes to 10 hours [step 10]; finish rolling at a working ratio R2 of 2.5% to 35% [step 11]; and temper annealing at 200° C. to 600° C. for 5 seconds to 10 hours [step 12].

The copper alloy sheet material of the present invention is preferably produced by the production method of the above-described embodiment, but if the ratio of the area of the atomic planes of grains having the S-orientation according to a crystal orientation analysis in EBSD measurement, satisfies the defined conditions, the method is not necessarily restricted to have all of the [step 1] to [step 12] in the sequence described above.

When the completion temperature of the hot rolling [step 3] is low, the speed of precipitation decreases, thus water cooling [step 4] is not necessarily required. At what temperature or lower the hot rolling should be finished so that water cooling would be unnecessary, depends on the alloy concentration or the amount of precipitation in the hot rolling, and it may be appropriately selected. Face milling [step 5] may be omitted, depending on the presence of scales on the material surface after the hot rolling. Furthermore, the scales may be removed, by dissolution with acid washing or the like.

In the production method of the present invention, by carrying out the hot working [step 3], such as the hot rolling, at a working ratio within the range of 50% or more at 500° C. or higher, and adding the heat treatment [step 7] which is carried out at 400° C. to 800° C. for a time period within the range of 5 seconds to 20 hours between the cold rolling [step 6] and the intermediate solution heat treatment [step 8], the ratio of the area of the crystal orientation region increases in which the deviation angle is within 30° from the S-orientation in the recrystallization texture resulting from the intermediate solution heat treatment [step 8].

It is also important to precipitate particles that suppress the grain boundary migration during the recrystallization of the intermediate solution heat treatment [step 8]. The heat treatment [step 7] is preferably carried out at 400° C. to 800° C. for 5 seconds to 20 hours so that the temperature is lower as compared with the temperature of the intermediate solution heat treatment [step 8]. The heat treatment is more preferably carried out at 450° C. to 750° C. for 30 seconds to 5 hours. Under conditions other than these conditions, precipitation of particles may result in insufficient.

Furthermore, the conditions for the hot rolling [step 3] need to be such that a state close to a supersaturated solid solution is obtained, in order to precipitate particles at a certain density in the heat treatment [step 7]. Also, when the grain size obtained after the hot rolling [step 3] is as coarse as 40 μm or more, development of a crystal orientation in which the deviation angle is within 30° from the S-orientation is difficult to occur in the cold rolling [step 6], which is not preferable. When the material temperature at the hot rolling [step 3] is lower than 500° C., precipitation proceeds, which is not preferable. Furthermore, in the case of a working ratio of less than 50%, the grain size obtained after the hot rolling [step 3] becomes coarse, which is not preferable. From the viewpoints discussed above, the hot rolling [step 3] is preferably carried out at a material temperature of 500° C. or higher at a working ratio of 50% or more. More preferably, the hot rolling is carried out at a material temperature of 550° C. or higher at a working ratio of 60% or more.

After the intermediate solution heat treatment [step 8], the cold rolling [step 9], the aging precipitation heat treatment [step 10], the finish cold rolling [step 11], and temper annealing [step 12] are carried out. In order to distinguish the cold rolling of step 6 from the cold rolling of step 9, the step 6 may be referred to as "cold rolling after the hot rolling", and the step 9 may be referred to as "cold rolling after the intermediate solution heat treatment." Herein, the sum of the respective working ratios R1 and R2 of the cold rolling after the intermediate solution heat treatment [step 9] and the finish cold rolling [step 11] is preferably within the range of 5% to 65%. More preferably, the sum of the working ratios R1 and R2 is 10% to 50%. If the sum of the working ratios R1 and R2 is less than 5%, the amount of work hardening is small, and the strength is insufficient. If the sum of the working ratios R1 and R2 is more than 65%, the materials is excessively work hardened, and therefore, bending property is markedly deteriorated.

The calculation of the working ratios R1 and R2 is carried out as follows.

$$R1(\%)=(t[8]-t[9])/t[9]\times 100$$

$$R2(\%)=(t[9]-t[11])/t[11]\times 100$$

In the formulas, t[8], t[9], and t[11] represent the respective sheet thicknesses after the intermediate solution heat treatment [step 8], after the cold rolling [step 9] after the intermediate solution heat treatment, and after the finish cold rolling [step 11].

Next, the effects of an additional element(s) to enhance the property(s) (secondarily property(s)), such as resistance to stress relaxation, will be described. Preferable examples of the additional element include Sn, Zn, Ag, and Mn. When the additional element is added, in order to sufficiently utilize the effects of adding the same and to prevent a lowering in the electrical conductivity, the additional element needs to be added in a total amount of 0.005 to 2.0 mass %, preferably 0.01 to 0.9 mass %, and more preferably 0.03 to 0.8 mass %. When these elements are contained in a total amount of more than 1 mass %, these elements cause an adverse affection of lowering the electrical conductivity, which is not preferable. When the total amount of these additive elements is less than 0.005 mass %, the effect of adding these elements is hardly exhibited.

The effects of addition of the respective elements will be described below. Mg, Sn, and Zn improve the stress relaxation resistance when added to Cu—Ni—Si-based, Cu—Ni—Co—Si-based, and Cu—Co—Si-based copper alloys. When these elements are added together, as compared with the case where any one of them is added singly, the stress relaxation resistance is further improved by synergistic effects. Furthermore, an effect of remarkably improving solder brittleness is obtained. Furthermore, when added, Ag has an effect of enhancing the mechanical strength, by solid solution effect (strengthening).

By satisfying the matters described above, the characteristics required of, for example, a copper alloy sheet material for connectors can be sufficiently satisfied.

Moreover, in the case of obtaining the copper alloy material of the present invention as a sheet material, there are no particular limitations on the sheet thickness, but it is preferable to set the thickness to, for example, within the range of 0.05 to 0.6 mm.

EXAMPLES

The present invention will be described in more detail based on examples given below, but the invention is not meant to be limited by these.

Example 1

An alloy containing the first elements to be added, in a respective proportion as shown in Tables 1 and 2, with the balance being Cu and unavoidable impurities, was melted in a high-frequency melting furnace. The resultant respective molten alloy was subjected to the casting [step 1] at a cooling speed of 0.1 to 100° C./second, to obtain an ingot. The resultant respective ingot was subjected to the homogenization heat treatment [step 2] at 900 to 1,020° C. for 3 min to 10 hours, followed by the hot rolling [step 3] at 500 to 1,020° C. at a working ratio of 50% to 95%, and then to a water quenching (corresponding to the water cooling [step 4]), and followed by the face milling [step 5] to remove oxidized scales. Then, the resultant respective worked and heat-treated alloy sheet was subjected to the cold rolling [step 6] at a working ratio of 80% to 99.8%, the heat treatment [step 7] at a temperature of 400° C. to 800° C. for a time period in the range of 5 seconds to 20 hours, the intermediate solution heat treatment [step 8] at 750° C. to 1,020° C. for 5 sec to 1 hour, the cold rolling (cold-rolling after the intermediate solution heat treatment) [step 9] at a working ratio of 3% to 35%, the aging precipitation heat treatment [step 10] at 400° C. to 700° C. for 5 min to 10 hours, the finish cold-rolling [step 11] at a working ratio of 3% to 25%, and the temper annealing [step 12] at 200° C. to 600° C. for 5 sec to 10 hours, to give test specimens, respectively. The thickness of the respective test specimen was set at 0.15 mm. The compositions and properties of the test specimens of Examples according to the present invention are shown in Table 1, and those of Comparative examples are shown in Table 2. After the respective heat treatment or rolling above, acid washing or surface polishing was carried out according to the state of oxidation or roughness of the material surface, and correction using a tension leveler was carried out according to the shape.

Comparative examples 1-5, 1-6, 1-7, and 1-8 in Table 2 were produced, by performing the hot rolling [step 3] at a temperature below 500° C., and performing the heat treatment [step 7] at a temperature below 400° C., in the process described above.

The thus-obtained test specimens were subjected to examination of the properties as described below.

a. Ratio of the Area of Region in Which Deviation Angle from the S-Orientation is Within 30° [S-Orientation] (Abbreviated to "[S]"):

The measurement was conducted by the EBSD method under the conditions of a measurement area of 500 $\mu m^2$ and a scan step of 0.5 μm. The area to be measured was adjusted on the basis of the condition of inclusion of 200 or more grains. As described above, with regard to the atomic planes of grains having a deviation angle of within 30° from the S-orientation, which is an ideal orientation, the areas of the relevant atomic planes were determined and summed. Furthermore, this sum value was divided by the total measured area, to thereby calculate the ratio of the area (%).

b. Bending Property:

Samples to be tested with width 10 mm and length 35 mm were cut perpendicularly to the rolling direction from the test specimens, respectively. The respective sample was subjected to W bending such that the axis of bending was perpendicular to the rolling direction, which is designated as GW (Good Way), and separately subjected to W bending such that the axis of bending was parallel to the rolling direction, which is designated as BW (Bad Way). The thus-bent portions were observed under an optical microscope with a magnification of 50×, to observe occurrence of cracks if any. According to the results, a sample which did not have any crack occurred at the bent portion was judged to be "good" (○), and a sample which had cracks occurred was judged to be "poor" (×), which are shown in the tables (Tables 1 and 2, in this Example 1). The bending angle at the respective bent portion was set at 90°, and the inner radius of the respective bent portion was set at 0.15 mm.

c. 0.2% Proof Stress [YS]:

Three test specimens that were cut out from the direction parallel to the rolling direction, according to JIS Z2201-13B, were measured according to JIS Z2241, and the 0.2% proof stress (yield strength) was shown as an average value of the results.

d. Electrical Conductivity [EC]:

The electrical conductivity (% IACS) was calculated, by using the four-terminal method, to measure the specific resistance of the material in a thermostat that was maintained at 20° C. (±0.5° C.). The spacing between terminals was 100 mm.

e. Particle Diameter and Distribution Density of the Second Phase [size and density of particles]:

The respective test piece was punched into a circle-shape with diameter 3 mm, followed by subjecting to film-polishing with a twin-jet polishing method, to give a test piece for observation. Photographs of the resultant test piece for observation were taken, each at arbitrarily ten fields, using a transmission electron microscope with acceleration voltage 300 kV with a magnification of 2,000× and a magnification of 40,000×, to measure the particle size and density of the second phase precipitates based on the photographs. Then, the number of particles in the respective field was counted, and the number obtained was converted into the number per unit area (/$mm^2$). An EDX analyzer attached to the TEM was utilized, to identify the respective compound.

e. Stress Relaxation Ratio [SR]:

The stress relaxation ratio (SRR) was measured according to the Japan Copper and Brass Association Technical Standards "JCBA T309:2001". FIGS. 1(*a*) and 1(*b*) are drawings explaining the method of testing resistance to stress relaxation. As shown in FIG. 1(*a*), the position of a test specimen 1 when an initial stress of 80% of the proof stress was applied to the test specimen 1 cantilevered on a test bench 4, is defined as the distance $\delta_0$ from the reference position. This test specimen was kept in a thermostat at 150° C. for 1,000 hours (which corresponds to the heat treatment at the state of the test specimen 1). The position of the test specimen 2 after removing the load, is defined as the distance $H_t$ from the reference position, as shown in FIG. 1(*b*). The reference numeral 3 denotes the test specimen to which no stress was applied, and the position of the test specimen 3 is defined as the distance $H_1$ from the reference position. Based on the relationships between those positions, the stress relaxation ratio (%) was calculated as: SR (%)=$\{(H_t-H_1)/(\delta_0-H_1)\}\times 100$.

g. Criteria on Judgment of the Properties

A copper alloy material is judged to have favorable properties, when meeting the conditions of: that a 0.2% proof stress (YS) is 600 MPa or more; that a bending property in terms of a value (r/t) is 1 or less, which value is obtained by dividing the minimum bending radius (r), capable of bending without any cracks in the 90° W-bending test, by the sheet thickness (t); that an electrical conductivity (EC) is 35% IACS or more; and that a stress relaxation resistance is 30% or less in terms of a stress relaxation ratio (SR).

As shown in Table 1, Examples 1-1 to 1-19 according to the present invention were excellent in all of the bending property, the proof stress, the electrical conductivity, and the stress relaxation resistance.

However, as shown in Table 2, when the requirements of the present invention were not satisfied, results were poor in any of the properties. That is, since Comparative example 1-1 had a too small total amount of Ni and Co, the density of the precipitates that contributes to precipitation hardening was decreased, and the mechanical strength was poor. Furthermore, Si that did not form a compound with Ni or Co, formed a solid solution in the metal texture excessively, and thus the electrical conductivity was poor. Comparative example 1-2 had a too large total amount of Ni and Co, and thus the

TABLE 1

| Identification | Alloying elements | | | | Bending property | | | | Particles | | |
|---|---|---|---|---|---|---|---|---|---|---|---|
| | Ni | Co | Si | [S] | (Cracks) | | YS | EC | Size | Density | SR |
| number | mass % | mass % | mass % | % | GW | BW | MPa | % IACS | nm | /mm$^2$ | % |
| Example 1-1 | 0.50 | 1.00 | 0.36 | 78 | ○ | ○ | 655 | 54.4 | 75 | $8\times10^7$ | 25.2 |
| Example 1-2 | 1.00 | 0.50 | 0.38 | 80 | ○ | ○ | 715 | 51.5 | 68 | $2\times10^7$ | 24.6 |
| Example 1-3 | — | 0.80 | 0.45 | 68 | ○ | ○ | 689 | 53.3 | 82 | $6\times10^6$ | 24.7 |
| Example 1-4 | 0.50 | 1.50 | 0.35 | 75 | ○ | ○ | 712 | 52.2 | 85 | $5\times10^7$ | 25.3 |
| Example 1-5 | 0.80 | 1.20 | 0.42 | 92 | ○ | ○ | 703 | 51.2 | 90 | $4\times10^6$ | 23.5 |
| Example 1-6 | 1.00 | 1.00 | 0.48 | 82 | ○ | ○ | 722 | 50.1 | 120 | $8\times10^6$ | 24.7 |
| Example 1-7 | 2.32 | — | 0.65 | 75 | ○ | ○ | 707 | 40.7 | 60 | $2\times10^6$ | 26.3 |
| Example 1-8 | 0.90 | 1.70 | 0.61 | 69 | ○ | ○ | 835 | 46.7 | 150 | $8\times10^5$ | 25.1 |
| Example 1-9 | 1.10 | 1.50 | 0.55 | 92 | ○ | ○ | 832 | 46.0 | 120 | $4\times10^6$ | 25.5 |
| Example 1-10 | — | 1.38 | 0.38 | 80 | ○ | ○ | 787 | 44.9 | 132 | $9\times10^5$ | 25.1 |
| Example 1-11 | 1.35 | 1.15 | 0.61 | 85 | ○ | ○ | 725 | 53.2 | 157 | $4\times10^6$ | 25.4 |
| Example 1-12 | 1.35 | 1.15 | 0.61 | 84 | ○ | ○ | 855 | 43.2 | 180 | $4\times10^6$ | 25.4 |
| Example 1-13 | 1.50 | 1.10 | 0.59 | 90 | ○ | ○ | 783 | 44.2 | 157 | $4\times10^6$ | 24.1 |
| Example 1-14 | — | 1.82 | 0.55 | 65 | ○ | ○ | 762 | 43.6 | 550 | $8\times10^4$ | 24.4 |
| Example 1-15 | 2.50 | 0.50 | 0.71 | 82 | ○ | ○ | 830 | 43.2 | 346 | $4\times10^5$ | 23.1 |
| Example 1-16 | 3.11 | — | 0.69 | 68 | ○ | ○ | 812 | 43.1 | 280 | $2\times10^6$ | 22.7 |
| Example 1-17 | 1.50 | 1.50 | 0.82 | 71 | ○ | ○ | 845 | 42.9 | 350 | $8\times10^5$ | 22.1 |
| Example 1-18 | 3.75 | — | 0.91 | 80 | ○ | ○ | 628 | 43.1 | 250 | $5\times10^6$ | 22.3 |
| Example 1-19 | 3.20 | 1.80 | 1.21 | 78 | ○ | ○ | 844 | 41.2 | 850 | $6\times10^4$ | 20.1 |

TABLE 2

| Identification | Alloying elements | | | | Bending property | | | | Particles | | |
|---|---|---|---|---|---|---|---|---|---|---|---|
| | Ni | Co | Si | [S] | (Cracks) | | YS | EC | Size | Density | SR |
| number | mass % | mass % | mass % | % | GW | BW | MPa | % IACS | nm | /mm$^2$ | % |
| Comparative example 1-1 | 0.13 | 0.13 | 0.36 | 65 | ○ | ○ | 425 | 29.2 | 220 | $8\times10^5$ | 25.1 |
| Comparative example 1-2 | 4.22 | 1.55 | 0.52 | 68 | ○ | ○ | 713 | 28.5 | 132 | $9\times10^5$ | 24.5 |
| Comparative example 1-3 | — | 0.80 | 0.07 | 63 | ○ | ○ | 382 | 45.2 | 210 | $3\times10^3$ | 24.6 |
| Comparative example 1-4 | 0.50 | 1.50 | 2.72 | 70 | ○ | ○ | 672 | 25.6 | 242 | $9\times10^6$ | 25.2 |
| Comparative example 1-5 | 0.80 | 1.20 | 0.42 | 25 | x | x | 765 | 51.0 | 120 | $4\times10^3$ | 23.4 |
| Comparative example 1-6 | 1.00 | 1.00 | 0.48 | 34 | x | x | 825 | 49.9 | 221 | $6\times10^3$ | 24.6 |
| Comparative example 1-7 | 2.32 | — | 0.65 | 48 | x | x | 795 | 40.5 | 155 | $5\times10^6$ | 26.2 |
| Comparative example 1-8 | 0.90 | 1.70 | 0.61 | 55 | x | x | 811 | 46.5 | 173 | $6\times10^6$ | 25.0 |

electrical conductivity was poor. Comparative example 1-3 had a too small amount of Si, and thus the mechanical strength was poor. Comparative example 1-4 had a too large amount of Si, and thus the electrical conductivity was poor. In Comparative examples 1-5, 1-6, 1-7, and 1-8, since the proportion of a deviation angle of within 30° from the S-orientation was too small, the bending property was poor.

Example 2

Utilizing the respective copper alloy containing the first elements to be added and the second elements to be added, in a respective proportion as shown in Tables 3 and 4, with the balance of Cu and unavoidable impurities, test specimens of copper alloy materials of Examples 2-1 to 2-19 according to the present invention and Comparative examples 2-1 to 2-3 were produced in the same manner as the production method described in Example 1. The thus-obtained test specimens were subjected to examination of the properties in the same manner as the testing and evaluation methods described in Example 1. The results are shown in Tables 3 and 4.

As shown in Table 3, Examples 2-1 to 2-19 according to the present invention were excellent in all of the bending property, the proof stress, the electrical conductivity, and the stress relaxation resistance.

However, as shown in Table 4, when the requirements of the present invention were not satisfied, any of the properties was poor. That is, since Comparative examples 2-1, 2-2, and 2-3 each had a too large content of other elements, the electrical conductivity thereof was poor.

Example 3

Utilizing the respective copper alloy containing the first elements to be added, the second elements to be added, and the third elements to be added, in a respective proportion as shown in Tables 5 and 6, with the balance of Cu and unavoidable impurities, test specimens of copper alloy materials of Examples 3-1 to 3-19 according to the present invention and Comparative examples 3-1 to 3-3 were produced in the same manner as the production method described in Example 1. The thus-obtained test specimens were subjected to exami-

TABLE 3

| Identification | Alloying elements | | | Other | [S] | Bending property (Cracks) | | YS | EC | Particles | | SR |
|---|---|---|---|---|---|---|---|---|---|---|---|---|
| | Ni | Co | Si | elements | | | | | | Size | Density | |
| number | mass % | mass % | mass % | mass % | % | GW | BW | MPa | % IACS | nm | /mm$^2$ | % |
| Example 2-1 | 0.50 | 1.00 | 0.36 | 0.05Zr, 0.05Hf | 80 | ○ | ○ | 668 | 52.8 | 83 | $7 \times 10^7$ | 24.2 |
| Example 2-2 | 1.00 | 0.50 | 0.38 | 0.15Mn, 0.05P | 82 | ○ | ○ | 729 | 50.0 | 75 | $3 \times 10^7$ | 23.6 |
| Example 2-3 | — | 0.80 | 0.45 | 0.05B, 0.15Cr | 69 | ○ | ○ | 703 | 51.7 | 90 | $7 \times 10^6$ | 23.7 |
| Example 2-4 | 0.50 | 1.50 | 0.35 | 0.15Ti, 0.15Mn | 77 | ○ | ○ | 726 | 50.6 | 94 | $6 \times 10^7$ | 24.3 |
| Example 2-5 | 0.80 | 1.20 | 0.42 | 0.08Fe | 94 | ○ | ○ | 717 | 49.7 | 99 | $5 \times 10^6$ | 22.6 |
| Example 2-6 | 1.00 | 1.00 | 0.48 | 0.21Ti, 0.05Fe | 84 | ○ | ○ | 736 | 48.6 | 132 | $6 \times 10^6$ | 23.7 |
| Example 2-7 | 2.32 | — | 0.65 | 0.15Cr | 77 | ○ | ○ | 721 | 39.4 | 66 | $3 \times 10^6$ | 25.3 |
| Example 2-8 | 0.90 | 1.70 | 0.61 | 0.15Cr, 0.10Fe | 70 | ○ | ○ | 852 | 45.3 | 165 | $7 \times 10^5$ | 24.1 |
| Example 2-9 | 1.10 | 1.50 | 0.55 | 0.05Fe | 94 | ○ | ○ | 849 | 44.6 | 132 | $5 \times 10^6$ | 24.5 |
| Example 2-10 | — | 1.38 | 0.38 | 0.10Mn, 0.05Fe, 0.05P | 82 | ○ | ○ | 803 | 43.5 | 145 | $6 \times 10^5$ | 24.1 |
| Example 2-11 | 1.35 | 1.15 | 0.61 | 0.22Mn, 0.04Zr | 87 | ○ | ○ | 740 | 51.6 | 173 | $3 \times 10^6$ | 24.4 |
| Example 2-12 | 1.35 | 1.15 | 0.61 | 0.05Ti, 0.05Al | 86 | ○ | ○ | 872 | 41.9 | 198 | $4 \times 10^6$ | 24.4 |
| Example 2-13 | 1.50 | 1.10 | 0.59 | 0.20Cr | 92 | ○ | ○ | 799 | 42.9 | 173 | $5 \times 10^6$ | 23.1 |
| Example 2-14 | — | 1.82 | 0.55 | 0.05P, 0.12Fe, 0.35Mn | 66 | ○ | ○ | 777 | 42.3 | 605 | $6 \times 10^4$ | 23.4 |
| Example 2-15 | 2.50 | 0.50 | 0.71 | 0.18Cr, 0.05P | 84 | ○ | ○ | 847 | 41.9 | 381 | $6 \times 10^5$ | 22.2 |
| Example 2-16 | 3.11 | — | 0.69 | 0.22Cr, 0.05Fe | 69 | ○ | ○ | 828 | 41.8 | 308 | $3 \times 10^6$ | 21.8 |
| Example 2-17 | 1.50 | 1.50 | 0.82 | 0.22Mn, 0.04Zr, 0.04B | 72 | ○ | ○ | 862 | 41.6 | 385 | $7 \times 10^5$ | 21.2 |
| Example 2-18 | 3.75 | — | 0.91 | 0.20Cr | 82 | ○ | ○ | 641 | 41.8 | 275 | $5 \times 10^6$ | 21.4 |
| Example 2-19 | 3.20 | 1.80 | 1.21 | 0.18Cr, 0.05Fe | 80 | ○ | ○ | 861 | 39.9 | 935 | $5 \times 10^4$ | 19.3 |

TABLE 4

| Identification | Alloying elements | | | Other elements | [S] | Bending property (Cracks) | | YS | EC | Particles | | SR |
|---|---|---|---|---|---|---|---|---|---|---|---|---|
| | Ni | Co | Si | | | | | | | Size | Density | |
| number | mass % | mass % | mass % | mass % | % | GW | BW | MPa | % IACS | nm | /mm$^2$ | % |
| Comparative example 2-1 | 2.32 | — | 0.65 | 0.62Mn, 0.42Fe | 68 | ○ | ○ | 849 | 28.2 | 132 | $6 \times 10^6$ | 23.1 |
| Comparative example 2-2 | 1.35 | 1.15 | 0.61 | 0.55Al, 0.72Ti | 82 | ○ | ○ | 740 | 26.3 | 66 | $3 \times 10^6$ | 23.4 |
| Comparative example 2-3 | — | 1.82 | 0.55 | 0.15P, 0.22B, 0.82Cr | 75 | ○ | ○ | 777 | 29.3 | 165 | $7 \times 10^5$ | 22.2 |

nation of the properties in the same manner as the testing and evaluation methods described in Example 1. The results are shown in Tables 5 and 6.

TABLE 5

| Identification number | Alloying elements Ni mass % | Co mass % | Si mass % | Other elements mass % | [S] % | Bending property (Cracks) GW | BW | YS MPa | EC % IACS | Particles Size nm | Density /mm$^2$ | SR % |
|---|---|---|---|---|---|---|---|---|---|---|---|---|
| Example 3-1 | 0.50 | 1.00 | 0.36 | 0.20Ag, 0.31Zn | 78 | ○ | ○ | 671 | 51.9 | 89 | $7 \times 10^7$ | 20.6 |
| Example 3-2 | 1.00 | 0.50 | 0.38 | 0.15Mn, 0.05P, 0.1Mg | 80 | ○ | ○ | 732 | 49.1 | 81 | $3 \times 10^7$ | 20.1 |
| Example 3-3 | — | 0.80 | 0.45 | 0.10Mg, 0.51Zn, 0.11Sn | 67 | ○ | ○ | 706 | 50.8 | 97 | $7 \times 10^6$ | 20.2 |
| Example 3-4 | 0.50 | 1.50 | 0.35 | 0.15Ti, 0.15Mn, 0.10Ag | 75 | ○ | ○ | 729 | 49.8 | 101 | $6 \times 10^7$ | 20.6 |
| Example 3-5 | 0.80 | 1.20 | 0.42 | 0.08Fe, 0.10Mg | 92 | ○ | ○ | 720 | 48.8 | 107 | $5 \times 10^6$ | 19.2 |
| Example 3-6 | 1.00 | 1.00 | 0.48 | 0.21Ti, 0.05Fe, 0.30Zn | 82 | ○ | ○ | 739 | 47.8 | 143 | $6 \times 10^6$ | 20.2 |
| Example 3-7 | 2.32 | — | 0.65 | 0.15Cr, 0.15Sn, 0.10Mg, 0.51Zn | 75 | ○ | ○ | 724 | 38.8 | 71 | $3 \times 10^6$ | 21.5 |
| Example 3-8 | 0.90 | 1.70 | 0.61 | 0.15Cr, 0.10Fe, 0.20Sn | 68 | ○ | ○ | 855 | 44.5 | 178 | $7 \times 10^5$ | 20.5 |
| Example 3-9 | 1.10 | 1.50 | 0.55 | 0.05Fe, 0.21Ag, 0.15Sn | 92 | ○ | ○ | 852 | 43.8 | 143 | $5 \times 10^6$ | 20.8 |
| Example 3-10 | — | 1.38 | 0.38 | 0.10Mn, 0.05Fe, 0.05P, 0.10Mg | 80 | ○ | ○ | 806 | 42.8 | 157 | $6 \times 10^5$ | 20.5 |
| Example 3-11 | 1.35 | 1.15 | 0.61 | 0.22Mn, 0.04Zr, 0.22Mg | 85 | ○ | ○ | 742 | 50.7 | 187 | $3 \times 10^6$ | 20.7 |
| Example 3-12 | 1.35 | 1.15 | 0.61 | 0.11Mg, 0.31Zn | 84 | ○ | ○ | 876 | 41.2 | 214 | $4 \times 10^6$ | 20.7 |
| Example 3-13 | 1.50 | 1.10 | 0.59 | 0.15Cr, 0.10Mg, 0.15Sn | 90 | ○ | ○ | 802 | 42.1 | 187 | $5 \times 10^6$ | 19.7 |
| Example 3-14 | — | 1.82 | 0.55 | 0.05P, 0.12Fe, 0.35Mn, 0.10Ag | 64 | ○ | ○ | 780 | 41.5 | 653 | $6 \times 10^4$ | 19.9 |
| Example 3-15 | 2.50 | 0.50 | 0.71 | 0.18Cr, 0.05P, 0.22Zn | 82 | ○ | ○ | 850 | 41.2 | 411 | $6 \times 10^5$ | 18.8 |
| Example 3-16 | 3.11 | — | 0.69 | 0.15Mg, 0.22Sn, 0.15Ag | 67 | ○ | ○ | 832 | 41.1 | 333 | $3 \times 10^6$ | 18.5 |
| Example 3-17 | 1.50 | 1.50 | 0.82 | 0.22Mn, 0.04Zr, 0.04B, 0.10Sn | 70 | ○ | ○ | 865 | 40.9 | 416 | $7 \times 10^5$ | 18.0 |
| Example 3-18 | 3.75 | — | 0.91 | 0.20Cr, 0.15Sn, 0.10Mg, 0.51Zn | 80 | ○ | ○ | 643 | 41.1 | 297 | $5 \times 10^6$ | 18.2 |
| Example 3-19 | 3.20 | 1.80 | 1.21 | 0.18Cr, 0.05Fe, 0.52Zn | 78 | ○ | ○ | 864 | 39.3 | 873 | $5 \times 10^4$ | 16.4 |

TABLE 6

| Identification number | Alloying elements Ni mass % | Co mass % | Si mass % | Other elements mass % | [S] % | Bending property (Cracks) GW | BW | YS MPa | EC % IACS | Particles Size nm | Density /mm$^2$ | SR % |
|---|---|---|---|---|---|---|---|---|---|---|---|---|
| Comparative example 3-1 | 2.32 | — | 0.65 | 0.15Cr, 0.52Sn, 0.42Mg, 1.22Zn | 66 | ○ | ○ | 849 | 28.2 | 120 | $6 \times 10^6$ | 22.1 |
| Comparative example 3-2 | 1.35 | 1.15 | 0.61 | 0.25Fe, 0.52Ti, 1.5Zn, 1.2Sn | 80 | ○ | ○ | 740 | 26.3 | 58 | $3 \times 10^6$ | 21.3 |
| Comparative example 3-3 | — | 1.82 | 0.55 | 0.15P, 0.22B, 2.22Sn | 73 | ○ | ○ | 777 | 29.3 | 143 | $7 \times 10^5$ | 20.5 |

As shown in Table 5, Examples 3-1 to 3-19 according to the present invention were excellent in all of the bending property, the proof stress, the electrical conductivity, and the stress relaxation resistance.

However, as shown in Table 6, when the requirements of the present invention were not satisfied, any of the properties was poor. That is, since Comparative examples 3-1, 3-2, and 3-3 each had a too large content of other elements, the electrical conductivity thereof was poor.

Example 4

Copper alloy materials of Example 4-1 to Example 4-12, and Comparative example 4-1 to Comparative example 4-10 were produced, by using the respective copper alloy having the composition (unit in mass %) shown in Table 7, under the conditions shown in Tables 8 and 9 for the hot rolling [step 3], the heat treatment [step 7], the cold rolling [step 9], and the finish cold rolling [step 11], and under the conditions described in Example 1 for the steps other than those mentioned above. The thus-obtained test specimens of the Examples and Comparative examples were subjected to examination of the properties in the same manner as the testing and evaluation methods described in Example 1. The results are shown in Tables 8 and 9. In Tables 8 and 9, the term "[step 3]" and the like are indicated simply as "[3]", the term "[step 7]" and the like simply as "[7]", the term "[step 9]" and the like simply as "[9]", and the term "[step 11]" and the like simply as "[11]".

TABLE 7

| Ni | Co | Si | Mg | Sn | Zn | Cr | Cu |
|---|---|---|---|---|---|---|---|
| 2.31 | 0.32 | 0.65 | 0.14 | 0.15 | 0.31 | 0.15 | Balance |

TABLE 8

| Identification number | Hot-rolling [3] Temp. ° C. | Hot-rolling [3] WR % | Heat-treatment [7] Temp. ° C. | Heat-treatment [7] Time | Cold-working [9] WR R1 % | Cold-working [11] WR R2 % | [S] % | Bending property (Cracks) GW | Bending property (Cracks) BW | YS MPa | EC % IACS | Particles Size nm | Particles Density /mm$^2$ | SR % |
|---|---|---|---|---|---|---|---|---|---|---|---|---|---|---|
| Example 4-1 | 720 | 88 | 600 | 60 sec | 40 | 5 | 82 | ○ | ○ | 716 | 44.2 | 79.5 | $5 \times 10^6$ | 21.2 |
| Example 4-2 | 670 | 75 | 750 | 15 sec | 30 | 10 | 84 | ○ | ○ | 686 | 39.4 | 173 | $7 \times 10^5$ | 23.7 |
| Example 4-3 | 740 | 63 | 500 | 5 min | 15 | 7 | 72 | ○ | ○ | 783 | 42.3 | 138 | $5 \times 10^6$ | 20.6 |
| Example 4-4 | 780 | 92 | 450 | 1 hour | 40 | 15 | 79 | ○ | ○ | 809 | 44.0 | 152 | $6 \times 10^5$ | 22.0 |
| Example 4-5 | 840 | 85 | 780 | 10 sec | 15 | 10 | 96 | ○ | ○ | 769 | 43.5 | 87 | $7 \times 10^6$ | 22.5 |
| Example 4-6 | 650 | 63 | 420 | 15 hour | 20 | 15 | 86 | ○ | ○ | 714 | 42.2 | 91 | $6 \times 10^7$ | 20.9 |
| Example 4-7 | 750 | 55 | 520 | 2 hour | 15 | 10 | 79 | ○ | ○ | 768 | 41.3 | 96 | $5 \times 10^6$ | 21.9 |
| Example 4-8 | 680 | 83 | 700 | 5 min | 20 | 13 | 73 | ○ | ○ | 759 | 42.8 | 87 | $4 \times 10^6$ | 21.6 |
| Example 4-9 | 820 | 52 | 550 | 30 min | 15 | 10 | 96 | ○ | ○ | 740 | 41.9 | 116 | $8 \times 10^6$ | 19.9 |
| Example 4-10 | 630 | 69 | 480 | 60 sec | 20 | 15 | 84 | ○ | ○ | 807 | 41.3 | 58 | $2 \times 10^6$ | 19.6 |
| Example 4-11 | 780 | 83 | 740 | 60 sec | 15 | 10 | 79 | ○ | ○ | 796 | 41.7 | 146 | $8 \times 10^5$ | 18.2 |
| Example 4-12 | 840 | 92 | 650 | 20 min | 40 | 5 | 83 | ○ | ○ | 770 | 41.3 | 73.7 | $2 \times 10^6$ | 18.6 |

Note:
"WR" means a working ratio
"Time" means a keeping time period at the temperature

TABLE 9

| Identification number | Hot-rolling [3] Temp. ° C. | Hot-rolling [3] WR % | Heat-treatment [7] Temp. ° C. | Heat-treatment [7] Time | Cold-working [9] WR R1 % | Cold-working [11] WR R2 % | [S] % | Bending property (Cracks) GW | Bending property (Cracks) BW | YS MPa | EC % IACS | Particles Size nm | Particles Density /mm$^2$ | SR % |
|---|---|---|---|---|---|---|---|---|---|---|---|---|---|---|
| Comparative example 4-1 | 450 | 60 | 520 | 2 hour | 30 | 15 | 32 | x | x | 762 | 45.2 | 1150 | $5 \times 10^3$ | 24.2 |
| Comparative example 4-2 | 750 | 35 | 700 | 5 min | 30 | 15 | 35 | x | x | 736 | 43.2 | 96 | $5 \times 10^6$ | 21.3 |
| Comparative example 4-3 | 750 | 70 | 350 | 2 hour | 30 | 10 | 52 | x | x | 836 | 41.3 | 87 | $4 \times 10^4$ | 22.5 |
| Comparative example 4-4 | 750 | 70 | 850 | 2 hour | 25 | 10 | 48 | x | x | 799 | 44.0 | 450 | $8 \times 10^5$ | 20.9 |
| Comparative example 4-5 | 750 | 70 | 600 | 3 sec | 25 | 10 | 38 | x | x | 801 | 44.0 | 68 | $6 \times 10^4$ | 22.0 |
| Comparative example 4-6 | 750 | 70 | 600 | 25 hour | 30 | 15 | 44 | x | x | 752 | 42.8 | 450 | $5 \times 10^4$ | 21.6 |
| Comparative example 4-7 | 750 | 70 | 520 | 2 hour | none | none | 65 | ○ | ○ | 582 | 41.9 | 91 | $6 \times 10^7$ | 20.3 |
| Comparative example 4-8 | 750 | 70 | 520 | 2 hour | 2 | 2 | 72 | ○ | ○ | 588 | 44.0 | 96 | $5 \times 10^6$ | 19.6 |
| Comparative example 4-9 | 750 | 70 | 520 | 2 hour | 40 | 30 | 75 | x | x | 821 | 41.3 | 87 | $4 \times 10^6$ | 18.2 |
| Comparative example 4-10 | 750 | 70 | 520 | 2 hour | 25 | 50 | 68 | x | x | 840 | 45.2 | 116 | $8 \times 10^6$ | 18.6 |

Note:
"WR" means a working ratio
"Time" means a keeping time period at the temperature As shown in Table 8, Examples 4-1 to 4-12 according to the present invention were excellent in all of the bending property, the proof stress, the electrical conductivity, and the stress relaxation resistance.

However, when the requirements of the present invention were not satisfied, results were poor in any of the properties. That is, in Comparative example 4-1, since the temperature of the hot rolling [step 3] was too low, the orientation having a deviation angle of within 30° from the S-orientation was insufficiently developed and the particles became coarse, to result in poor in the bending property. In Comparative example 4-2, since the working ratio of the hot rolling [step 3] was too low, the orientation having a deviation angle of within 30° from the S-orientation was insufficiently developed, to result in poor in the bending property. In Comparative example 4-3, since the temperature of the heat treatment [step 7] was too low; in Comparative example 4-4, since the temperature of the heat treatment [step 7] was too high; and in Comparative example 4-5, the time period of the heat treatment [step 7] was too short; and in Comparative example 4-6, the time period of the heat treatment [step 7] was too long, the orientation having a deviation angle of within 30° from the S-orientation was insufficiently developed, to result in poor in the bending property in the respective cases. Comparative examples 4-7 and 4-8 each had a too small sum of the working ratios of R1 and R2, and thus the mechanical strength was poor. Comparative examples 4-9 and 4-10 each had a too large sum of the working ratios R1 and R2, and thus the bending property was poor.

As discussed in the above, from the results in the examination of the properties in the above Examples, the present invention is advantageous in that such favorable characteristics can be realized that the 0.2% proof stress is 600 MPa or more; the value indicating the bending property, which value is obtained by dividing the minimum bending radius capable of bending without any cracks in the 90° W-bending test, by the sheet thickness, is 1 or less (the bending test is carried out in a state where the value obtained by dividing the bending radius by the sheet thickness is 1(r/t=1), and no crack occurs); the electrical conductivity is 35% IACS or more; and the stress relaxation resistance is 30% or less in terms of the stress relaxation ratio.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-271967 filed in Japan on Oct. 22, 2008, which is entirely herein incorporated by reference.

Reference Signs List

1 Test specimen with an initial stress applied thereon
2 Test specimen after removing the load
3 Test specimen without any stress applied thereon
4 Test bench

The invention claimed is:

1. A copper alloy material, having an alloy composition comprising any one or both of Ni and Co in an amount of 0.4 to 5.0 mass % in total, Si in an amount of 0.1 to 1.5 mass %, at least one element selected from a second group of elements to be added consisting of B, P, Cr, Fe, Ti, Zr, Mn, Al, and Hf in an amount of 0.005 to 1.0 mass % in total, and at least one element selected from a third group of elements to be added consisting of Sn, Zn, Ag, and Mg in an amount of 0.005 to 2.0 mass % in total, with the balance being copper and unavoidable impurities, wherein a ratio of an area of grains in which an angle of orientation deviated from S-orientation {2 3 1}<3 4 6> is within 30°is 60 % or more, according to a crystal orientation analysis in EBSD measurement.

2. The copper alloy material according to claim 1, wherein at least one kind of particles selected from the group consisting of: particles which are composed of at least two elements among a first group of elements to be added consisting of Ni, Co, and Si and have a diameter of 50 to 1,000 nm; particles which contain at least one element selected from the first group of elements to be added and at least one element selected from the second group of elements to be added as constituent elements and have a diameter of 50 to 1,000 nm; and particles which contain at least two elements selected from the second group of elements to be added as constituent elements and have a diameter of 50 to 1,000 nm, exist in a density from $10^4/mm^2$ to $10^8/mm^2$ in total.

3. An electrical or electronic part formed by working the copper alloy material according to claim 1.

4. A method of producing the copper alloy material according to claim 1, comprising the steps of:

casting a copper alloy to give the alloy composition, to obtain an ingot [step 1]; subjecting the ingot to a homogenization heat treatment [step 2]; hot rolling the homogenization heat treated ingot [step 3]; cold rolling [step 6]; subjecting to a heat treatment [step 7]; subjecting to an intermediate solution heat treatment [step 8]; cold rolling [step 9]; subjecting to an aging precipitation heat treatment [step 10]; finish cold rolling [step 11]; and temper annealing [step 12], in this order as mentioned, wherein the step of hot rolling [step 3] is carried out at a working ratio of 50% or more at 500° C. or above; the step of heat treatment [step 7] is carried out at 400° C. to 800° C. for a time period within the range of 5 seconds to 20 hours; and when the working ratio in the step of cold rolling [step 9] is designated as R1(%) and the working ratio in the step of finish cold rolling [step 11] is designated as R2(%), the value of R1+R2 is set to the range of 5 to 65%.

* * * * *